United States Patent [19]

Marchais

[11] 4,286,713

[45] Sep. 1, 1981

[54] COVER FOR A STANDARD CONTAINER

[75] Inventor: Jean-Claude Marchais, l'Hay les Roses, France

[73] Assignee: CIDELCEM, Paris, France

[21] Appl. No.: 114,163

[22] Filed: Jan. 22, 1980

[30] Foreign Application Priority Data

Jan. 24, 1979 [FR] France ..... 79 01788

[51] Int. Cl.[3] ..... B65D 21/02

[52] U.S. Cl. ..... 206/508; 206/509; 220/352; 220/380

[58] Field of Search ..... 220/307, 352, 353, 354, 220/355, 287, 380; 206/508, 509, 503; 150/0.5

[56] References Cited

U.S. PATENT DOCUMENTS

| | | | |
|---|---|---|---|
| 2,412,325 | 10/1946 | Devine . | |
| 2,695,115 | 11/1954 | Roop | 220/355 |
| 3,378,177 | 4/1968 | Gran | 206/508 |

FOREIGN PATENT DOCUMENTS

| | | | |
|---|---|---|---|
| 2400464 | 4/1979 | France | 206/508 |
| 572551 | 10/1945 | United Kingdom | 206/508 |
| 961858 | 6/1964 | United Kingdom | 206/508 |

*Primary Examiner*—George E. Lowrance
*Attorney, Agent, or Firm*—Sughrue, Mion, Zinn, Macpeak and Seas

[57] ABSTRACT

A cover (1) for a standard container (2), has a substantially rectangular bottom (3) and a substantially rectangular opening (4) at the top. The cover (1) includes lower rib portions (6) which are disposed in a substantially rectangular configuration with rounded corners which fit into the opening (4) of the container (2) and upper rib portions (8) which are disposed in a rectangular configuration dimensioned almost similar to those of the set of lower rib portions (6). The rib portions (6,8) are separated by gaps (7,9) which allow easy washing, and the gaps (7) of one set of rib portions (6) are not adjacent to the gaps (9) of the other set of rib portions (8). To make it easier to grip the cover (1), a portion of its edge is raised to form a handle (10) adjacent to a rib portion (8) of the upper set. Stacking of containers on covers and stacking of covers one on another is thereby greatly facilitated.

6 Claims, 6 Drawing Figures

COVER FOR A STANDARD CONTAINER

BACKGROUND OF THE INVENTION

The present invention relates to a cover for a standard container, said container having a substantially rectangular bottom with rounded corners and side walls that are flared upwards, the tops of the side walls delimiting a substantially rectangular opening with rounded corners, said cover being constituted by a plate made of a thermo-plastic material and provided with upper rib portions which project from its upper surface in a rectangular configuration with gaps and with lower rib portions which project from its lower surface in a substantially rectangular configuration to fit into the opening.

Such a cover is described in U.S. Pat. No. 2,695,115. The cover described in said patent is provided with two sets of lower ribs, the first of which fits inside the opening of the container and the second of which fits round the outside of the container. Further, the second set of lower ribs makes it difficult to lift the cover with one hand.

The set of upper ribs on the cover described in the above U.S. patent co-operates with a set of ribs located beneath another container.

Since the containers are flared, is not easy to arrange for the set of upper ribs on a cover to match both the set of ribs on the bottom of a second container and the set of lower ribs of an identical cover. In other words, it is difficult to ensure that a pile of identical covers will stack properly, if the covers are specifically designed for proper stacking of closed containers, and vice versa.

Further, the second set of lower ribs which project further than the first set of lower ribs interferes with proper nested stacking of the covers on one another.

SUMMARY OF THE INVENTION

The cover according to the present invention mitigates these disadvantages and is characterized in that the upper rib portions surround the bottom of a container placed on the cover and in that the cover has only one set of lower rib portions which fits inside the opening of a container closed by the cover and said set of lower rib portions being of a slightly different size to that of the set of upper rib portions so that the bottom of the standard container placed on the cover cannot move sideways, and likewise another cover identical to the cover in question and stacked thereon, said lower rib portions being separated by gaps which are not adjacent to gaps separating the upper ribs.

The gaps between the rib portions allow washing water to be removed and since the gaps between the upper rib portions are not adjacent to the gaps between the lower rib portions, the lower rib portions and the upper rib portions co-operate to stiffen the cover.

According to a preferred embodiment of the invention, one of the sets of rib portions has a rectangular configuration with rounded corners, the gaps thereof being situated in the middle of each side of the rectangle, while the other set of rib portions also has a rectangular configuration but with the gaps located at the corners of the rectangle.

Preferably, the set of rib portions which has a rectangular configuration with rounded corners and with a passage in the middle of each side of the rectangle is the lower set of rib portions.

According to one improvement of the invention, the cover includes at least one raised edge portion placed adjacent to an interrupted length of an upper rib portion to make it easier to grip the cover.

Preferably, each raised edge portion is situated on the same side of each plane of symmetry of the cover and of its container.

Lastly, when the bottom of the container has an inwardly curved shape, the central portion of the cover can also have a curved shape which is complementary to the curved shape of the container.

The present invention will be better understood from the following description and from the accompanying drawings.

DESCRIPTION OF PREFERRED EMBODIMENTS

Figure 1:
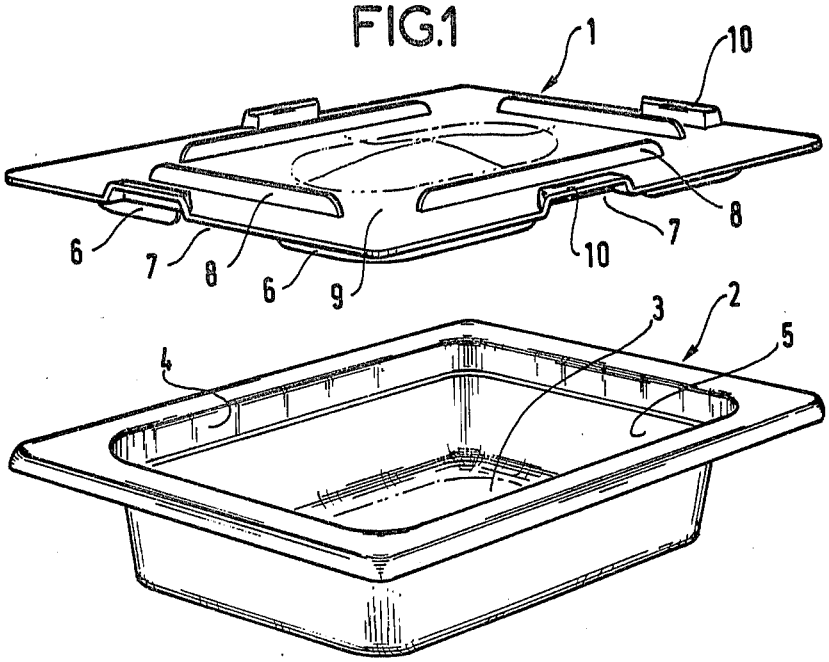
FIG. 1 is a perspective view of the cover in accordance with the invention in conjunction with a standard container.

A cover 1 in accordance with the invention is constituted by a plate of thermo-plastic material and is intended to cover a container 2 which has a bottom 3 of substantially rectangular shape with rounded corners. Side walls 4 of the container 2 are flared outwardly from the bottom upwards, and have tops which delimit an opening 5 which is substantially rectangular with rounded corners.

The cover 1 is provided with a set of lower rib portions 6 disposed in a rectangular configuration with rounded ends. Said lower rib portions fit into the opening 5. The rib portions 6 are separated from one another by gaps 7 in the middle of each side of the cover 1 (see also FIG. 3).

The cover 1 is also provided with a set of upper rib portions 8 disposed in a rectangular configuration with gaps 9 between said portions; the gaps 9 are located at the corners of the cover 1.

The dimensions of the set of upper rib portions 8 are slightly smaller than those of the set of lower rib portions 6, the rectangle formed by the set of upper rib portions being locatable inside the rectangle formed by the lower rib portions.

Portions of the edge of the cover are turned up to form four handles 10 each disposed facing an uninterrupted length of a respective one of the upper rib portions 8.

Figure 2:
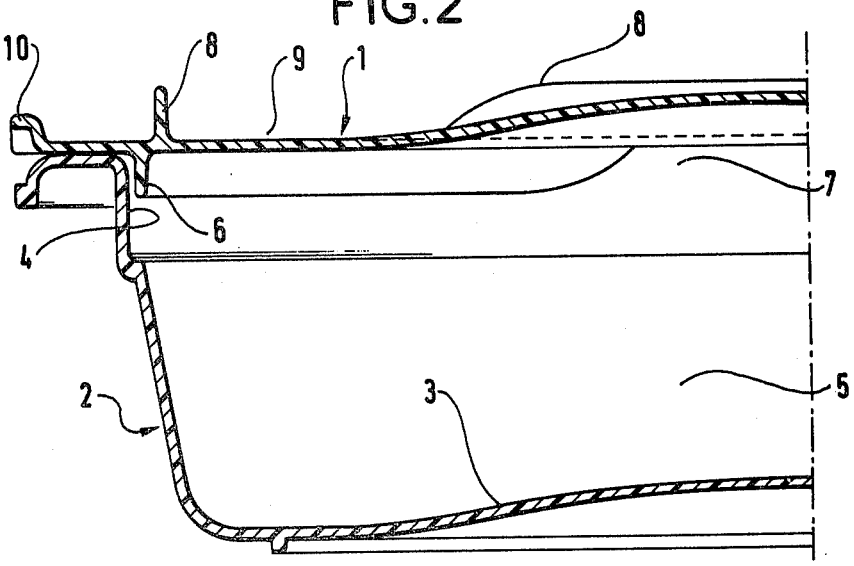
FIG. 2 is a half cross-section of the cover in accordance with the invention, fitted on a container.

In FIG. 2, the cover 1 is laid on the container 2 and the lower rib 6 is fitted into the opening 5.

The bottom 3 of the container 2 is curved inwards and the central portion of the cover 1 is curved outwards so that the two curves are complementary to each other.

To remove the cover, it is necessary only to grip a handle 10 and an upper rib portion 8 with the thumb and the index finger before lifting.

Figure 3:
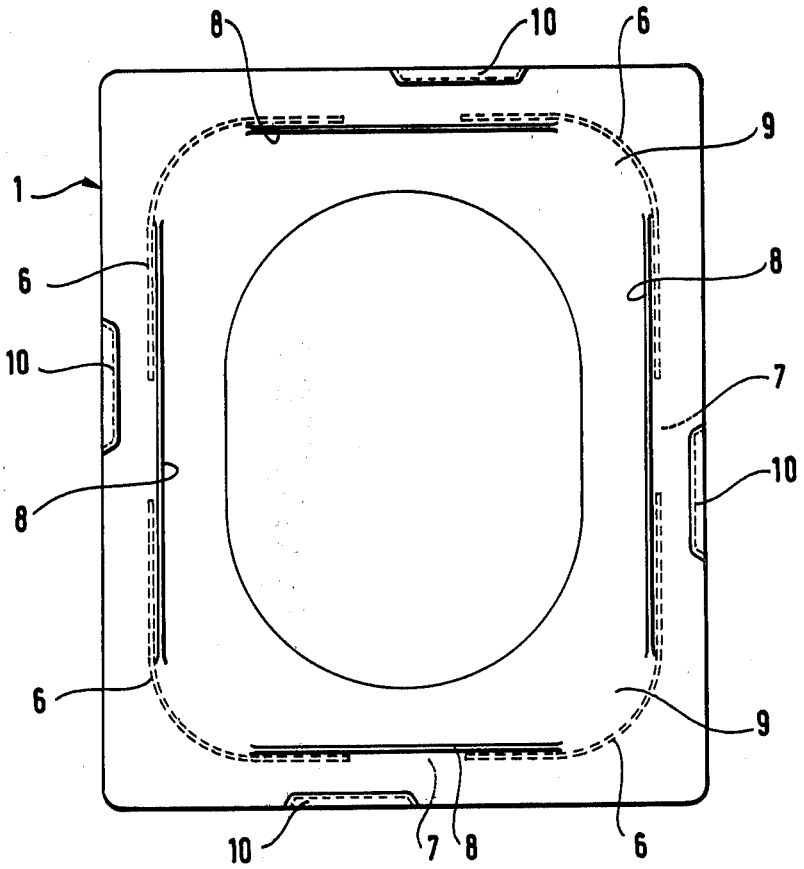
FIG. 3 is a plan view of a cover in accordance with the invention on a smaller scale than FIG. 2.

FIG. 3 is a plan of a cover in accordance with the invention. Continuous lines in the figure illustrate the upper rib portions 8 with gaps 9 therebetween and dotted lines illustrate the lower rib portions 6 with gaps 7 therebetween.

Thus, when the covers are washed and left to dry, water can flow away through the gaps without being stopped by the ribs.

Further, since the gap between any two rib portions is adjacent to an ininterrupted length of another rib portion, both ends of rib portions co-operate efficiently in stiffening the cover.

Figure 4:
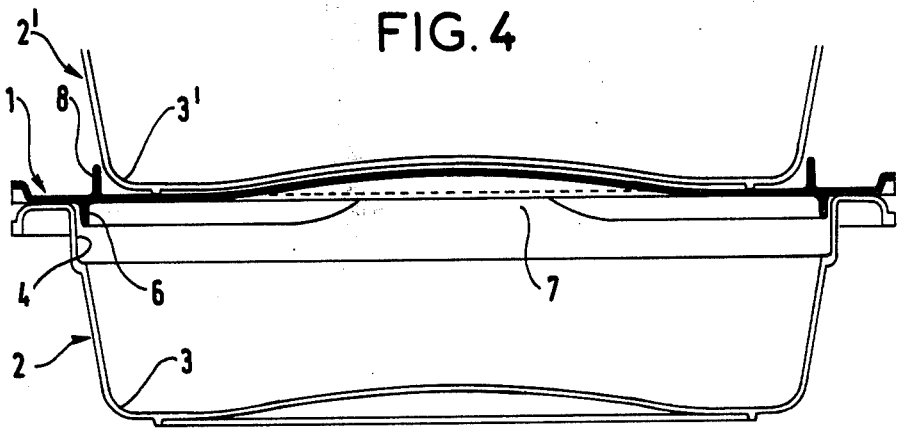
FIG. 4 is a vertical sectional view which illustrates a container stacked on a cover.

In FIG. 4, a container 2' is stacked on the cover 1.

The curved bottom 3' of the container 2' matches the curved shape of the cover 1 and side play of the container 2' is prevented by the set of upper rib portions 8 on the cover 1.

Figure 5:
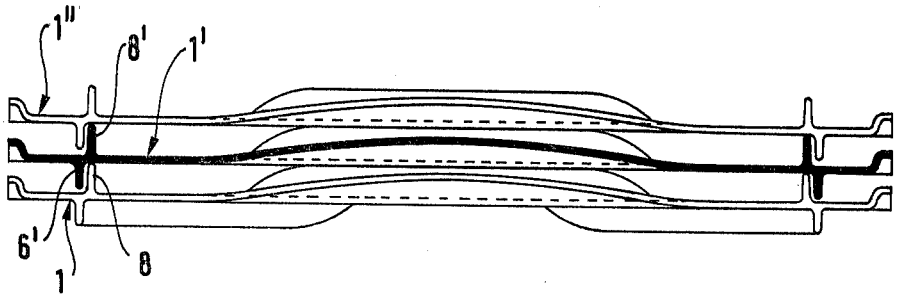
FIG. 5 is a vertical sectional view which illustrates covers stacked on one another.

FIG. 5 illustrates a plurality of covers 1, 1', 1'' stacked on one another, with the upper rib portions of one cover nesting in the lower rib portions of the next cover up. For example the lower rib portions 6' of the cover 1' fit fairly closely around the upper rib portions 8 of the cover 1.

It is obvious that the dimensions of the upper rib portions can be slightly larger than those of the lower rib portions without hindering stacking.

Figure 6:
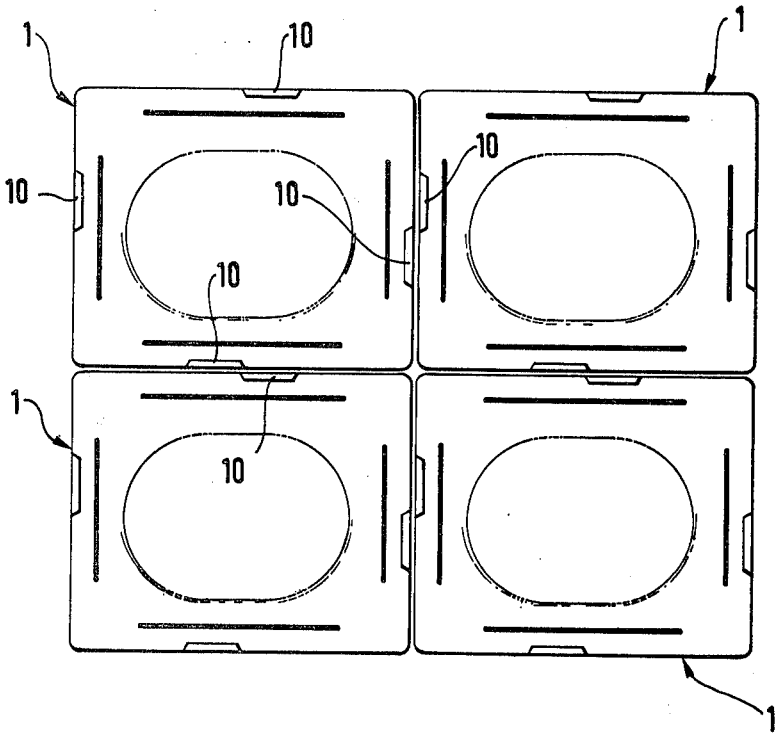
FIG. 6 is a top plan view of a plurality of containers with their covers juxtaposed.

FIG. 6 illustrates a plan of several covers on juxtaposed containers. To facilitate gripping, the handles 10 are disposed asymmetrically so that the handles of two juxtaposed containers are not exactly opposite each other.

I claim:

1. A cover for a standard container, said container having a substantially rectangular bottom with rounded corners and side walls that are outwardly flared upwards, the tops of the side walls delimiting a substantially rectangular opening with rounded corners, said cover being constituted by a plate guide made of a thermo-plastic material and provided with upper rib portions which project from its upper surface in a rectangular configuration with gaps therebetween and with lower rib portions which project from its lower surface in a substantially rectangular configuration to fit into the opening; the improvement wherein the upper rib portions (8) surround the bottom (3) of an underlying container (2) placed on the cover (1) and wherein said cover (1) has only one set of lower rib portions (6) which fits inside the opening (5) of a container closed by the cover and said set of lower rib portions (6) defining a rectangular configuration and being of a slightly different size to that formed by the set of upper rib portions (8) so that the bottom (3) of the standard container (2) placed on the cover (1) cannot move sideways, and likewise another cover (1') identical to the cover (1) in question and stacked thereon, and wherein said lower rib portions (6) being separated by gaps (7) which are not adjacent to gaps (9) separating the upper ribs (8).

2. A cover according to claim 1, wherein one of said sets of rib portions (6) has a rectangular configuration with rounded corners, the gaps (7) thereof being situated in the middle of each side of the rectangle, while the other set of rib portions (8) also has a rectangular configuration but having the gaps located at the corners of the rectangle.

3. A cover according to claim 2, wherein said one set of rib portions which has a rectangular configuration with rounded corners and with a passage in the middle of each side of the rectangle being the lower set of rib portions (6).

4. A cover according to claim 1, wherein said cover includes at least one raised edge portion (10) placed adjacent to an uninterrupted length of an upper rib portion (8) to make it easier to grip the cover (1).

5. A cover according to claim 4, wherein each raised edge portion (10) is situated on the same side of each plane of symmetry of the cover (1) and of its container (2).

6. A cover according to claim 1, for a container with an inwardly curved bottom, wherein the central portion of the cover (1) has a shape corresponding to that of the container bottom to allow the bottom of an identical container (1'0 to be placed thereon.

* * * * *